US006687954B2

(12) United States Patent
Zingg

(10) Patent No.: US 6,687,954 B2
(45) Date of Patent: Feb. 10, 2004

(54) PULLEY, CRADLE ARRANGEMENT FOR A SLIDING DOOR

(75) Inventor: Heinz Zingg, Niederuzwil (CH)

(73) Assignee: EKU AG, Sirnach (CH)

( * ) Notice: Subject to any disclaimer, the term of this patent is extended or adjusted under 35 U.S.C. 154(b) by 0 days.

(21) Appl. No.: 10/108,748

(22) Filed: Mar. 28, 2002

(65) Prior Publication Data

US 2002/0138943 A1 Oct. 3, 2002

(30) Foreign Application Priority Data

Mar. 30, 2001 (CH) ..... 0596/01

(51) Int. Cl.[7] ..... A47H 15/00

(52) U.S. Cl. ..... 16/97; 16/87 R; 16/105; 49/425

(58) Field of Search ..... 16/105, 87 R, 16/97, 98, DIG. 31; 49/370, 394, 449, 424–428

(56) References Cited

U.S. PATENT DOCUMENTS 3,670,357 A * 6/1972 Steigerwald ..... 16/105
3,959,849 A * 6/1976 Marquardt ..... 16/105
4,134,178 A * 1/1979 Stevens ..... 16/100
4,282,631 A * 8/1981 Uehara et al. ..... 16/102
4,850,078 A * 7/1989 Libby et al. ..... 16/100
5,671,502 A * 9/1997 Ezman ..... 16/105
5,673,516 A * 10/1997 Hughes et al. ..... 49/425
5,819,371 A * 10/1998 Rock et al. ..... 16/258
5,845,363 A * 12/1998 Brempell et al. ..... 16/105
5,927,017 A * 7/1999 Jacobs et al. ..... 49/410
5,974,738 A * 11/1999 Jacobs ..... 49/425
6,021,547 A * 2/2000 Stagoll ..... 16/105
6,463,625 B2 * 10/2002 Mittag ..... 16/97
2001/0003855 A1 * 6/2001 Zingg ..... 16/105

* cited by examiner

*Primary Examiner*—Anthony Knight
*Assistant Examiner*—André L. Jackson
(74) *Attorney, Agent, or Firm*—Volpe and Koenig, P.C.

(57) ABSTRACT

A pulley cradle arrangement for a screen doors, in particular, having a pulley cradle receptacle (23) that is inserted from above into a hollow frame section (1) and is clamped there. The pulley cradle receptacle (23) holds the pulley cradle support (25), inside of which the pulley cradle (27) and its running rollers (28) can be shifted vertically by a knurled screw (89). All parts can be pushed together without the use of tools and snap together by means of elastic holders. The pulley cradle (27) can be removed from the pulley cradle support (25) by pushing on its front surface and thus the sliding door can be removed from the guide rails.

9 Claims, 4 Drawing Sheets

3
3'
7
5'
19
A
15
7
II
II
17
11
21
13
1

5

19
15
17
13
21

C
B
23
29
31
33
35
37
39
41
43
45
47
49
51
53
55
75
87

PUSH
E
D
F
25
27
28
57
59
61
63
65
67
68
69
71
73
75
77
79
81
83
85
87
89
90
91
IX
XIII
XVIII

PUSH
28
55'
51
55
9
XIV
27
53
7
53'
49
26
23
89
1
11
53'

PULLEY, CRADLE ARRANGEMENT FOR A SLIDING DOOR

BACKGROUND

The invention is directed to a pulley cradle arrangement for a sliding door with a frame made of hollow profiles, in which a pulley cradle receptacle is inserted into the upper frame section to connect the sliding door to the pulley cradle.

Pulley cradles for sliding doors are known from the state of the art with many designs. There are generally two types of arrangements, namely those in which the sliding door is hung off of the pulley cradle, i.e. the guide rail that supports the sliding door is above the sliding door, and those in which the pulley cradle supports the sliding door and rides in a guide rail below the sliding door. In sliding doors that have a frame made of wood, the pulley cradles are commonly inserted into pot-shaped holes located at the back of the sliding door near the top or bottom edge. In sliding doors with a frame made of metal, in particular hollow profiles, such as are used in screen doors, for example, the pulley cradles are inserted into the hollow profile. In a known pulley cradle, a recess is provided in front on the frame of the sliding door, by means of which the pulley cradle can be introduced from the side into the upper cross beam and can be fixed there using suitable means. In order to adjust the sliding door or guide rail in hanging sliding doors, the adjustment can be made in these known recesses using a screwdriver or a similar tool through a front opening in the vertical side of the frame. These known pulley cradles achieve their goal adequately; however, they are complicated with regard to their assembly in the frame as well as their adjustment and are thus expensive.

There is also a known height-adjustable pulley cradle that can be adjusted vertically by means of a fluted or cogged wheel accessible in front. This known pulley cradle is provided for installation into a pulley cradle receptacle in a pot-shaped hole. This cannot be used in a frame made from hollow profiles, for example a screen doors.

SUMMARY

The object of this invention is thus to create a pulley cradle arrangement to be installed in sliding doors with hollow-profiled frames, and which can be adjusted without the use of tools.

This object is met by a pulley cradle arrangement with the features of patent claim 1. Advantageous embodiments are defined in the dependent claims.

The pulley cradle according to the invention is capable of being assembled inside of a horizontal cross beam made of hollow profile, as well as having its height adjusted subsequently without the use of tools. The connection between the pulley cradle that is introduced ahead of time into the guide rail to the receptacle inserted into the cross beam or frame of the sliding door can be done by simply moving the sliding door up to the pulley cradle and snapping the latter inside of the receptacle inserted into the frame. By manually pressing on the pulley cradle using a finger or a pin, the sliding door can again be removed from guide rail. A vertical follow-up adjustment of the sliding door can be done at any time without disassembling the latter and without using a tool. The recess in the frame, which is used to insert the receptacle for the running carriaige, can be done by means of a simple stamping process without high precision when the frame is manufactured. The vertical crossbeams of the sliding door thus require no openings; the recess visible on the surface, through which the adjustment as well as the removal of the connection mechanism/sliding door is done, can be located on the back of the sliding door. The pulley cradle arrangement can in addition be manufactured cost-effectively.

BRIEF DESCRIPTION OF THE DRAWINGS

The invention is explained in more detail with the help of a preferred embodiment. In the drawings:

FIG. 18 is a cross section taken along line XVIII—XVIII in FIG. 12.

DETAILED DESCRIPTION OF THE PREFERRED EMBODIMENT

Figures 1, 2, 3:
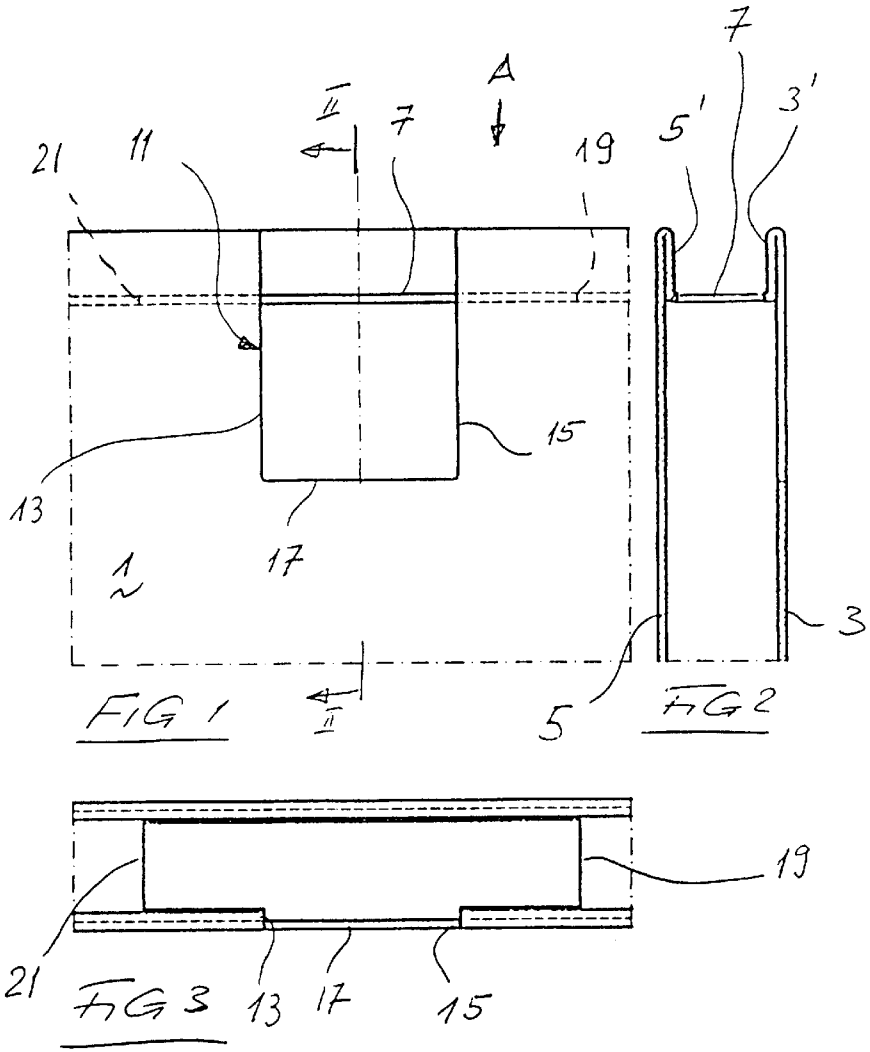
FIG. 1 is a cross-sectional view of an upper frame profile of a sliding door.
FIG. 2 is a vertical section through the frame section in FIG. 1 along line II—II, FIG. 3 a view from direction A of the frame section in FIG. 1.

In FIG. 1, reference number 1 represents a section of a spar or frame part that is essentially rectangular in cross section, with a front wall 3 and a rear wall 5. The bottom side that connects the two walls (front wall and rear wall 3,5) together below is not shown. The two upper edges of the two walls 3, 5 are tucked inward or folded in the example shown so that two equally long wall sections 5' and 3' run parallel and downward adjacent to the two walls 3, 5 and have ends that are connected together by a flange 7. The frame profile is preferably produced from flat strips made of steel or aluminum by multiple folding and bending. The front wall 3 is provided with a rectangular cutout 11 in the location where a pulley cradle 9 is to be placed. The cutout 11 has two side edges 13 and 15 as well as a lower base edge 17 that connects the two side edges 13, 15. The flange 7 that connects the two walls 3, 5 is also cut away in the area of the cutout, with the cut-away portion of the flange 7 extending laterally beyond the two side edges 13 and being bordered by stamped edges 19 and 21.

Figures 15, 16, 17:
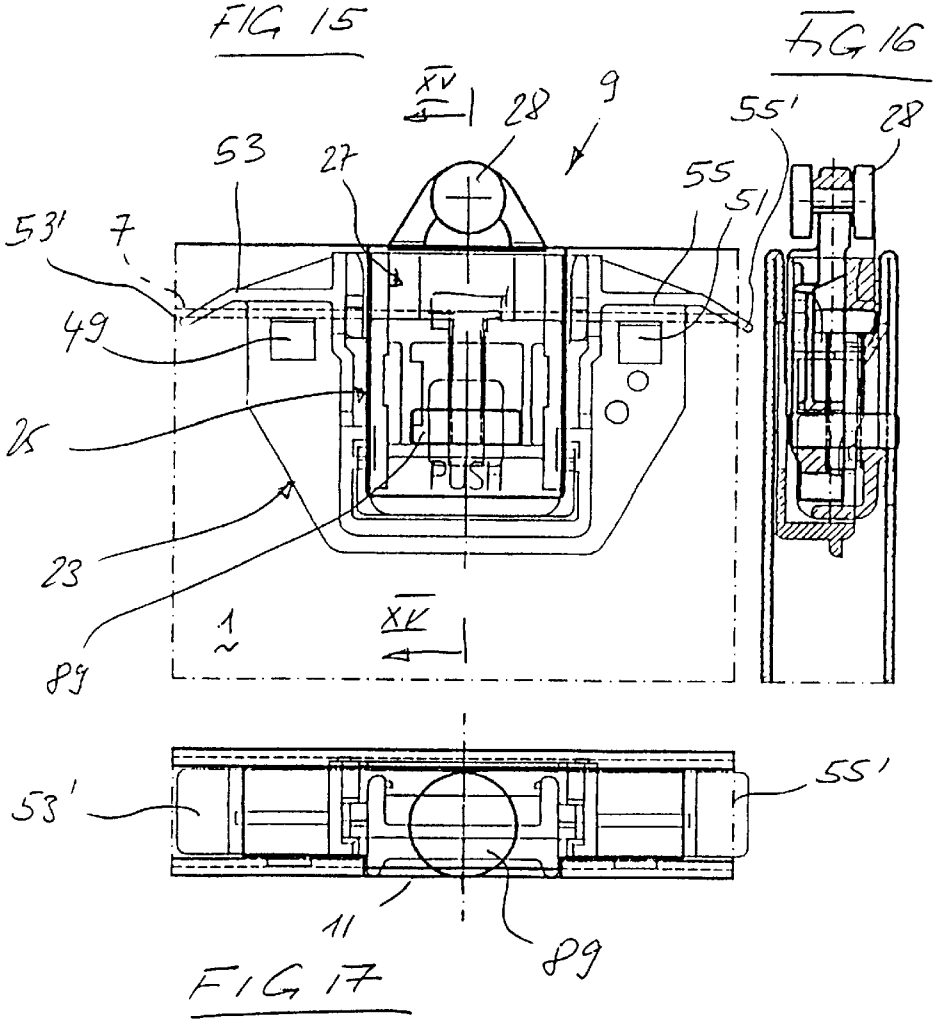
FIG. 15 is a front view of a pulley cradle inserted into the frame.
FIG. 16 is a vertical section through the inserted pulley cradle along line XV—XV in FIG. 15.
FIG. 17 is a view of the frame with the inserted pulley cradle in FIG. 15.

The pulley cradle 9, shown inserted into frame section 1 in FIG. 15, has essentially three main parts. They are the pulley cradle receptacle 23 that is inserted into the frame 1, the pulley cradle support 25 that forms the connection to the receptacle and the pulley cradle 27 with running wheels 28.

Figures 4, 5, 6, 7, 8:
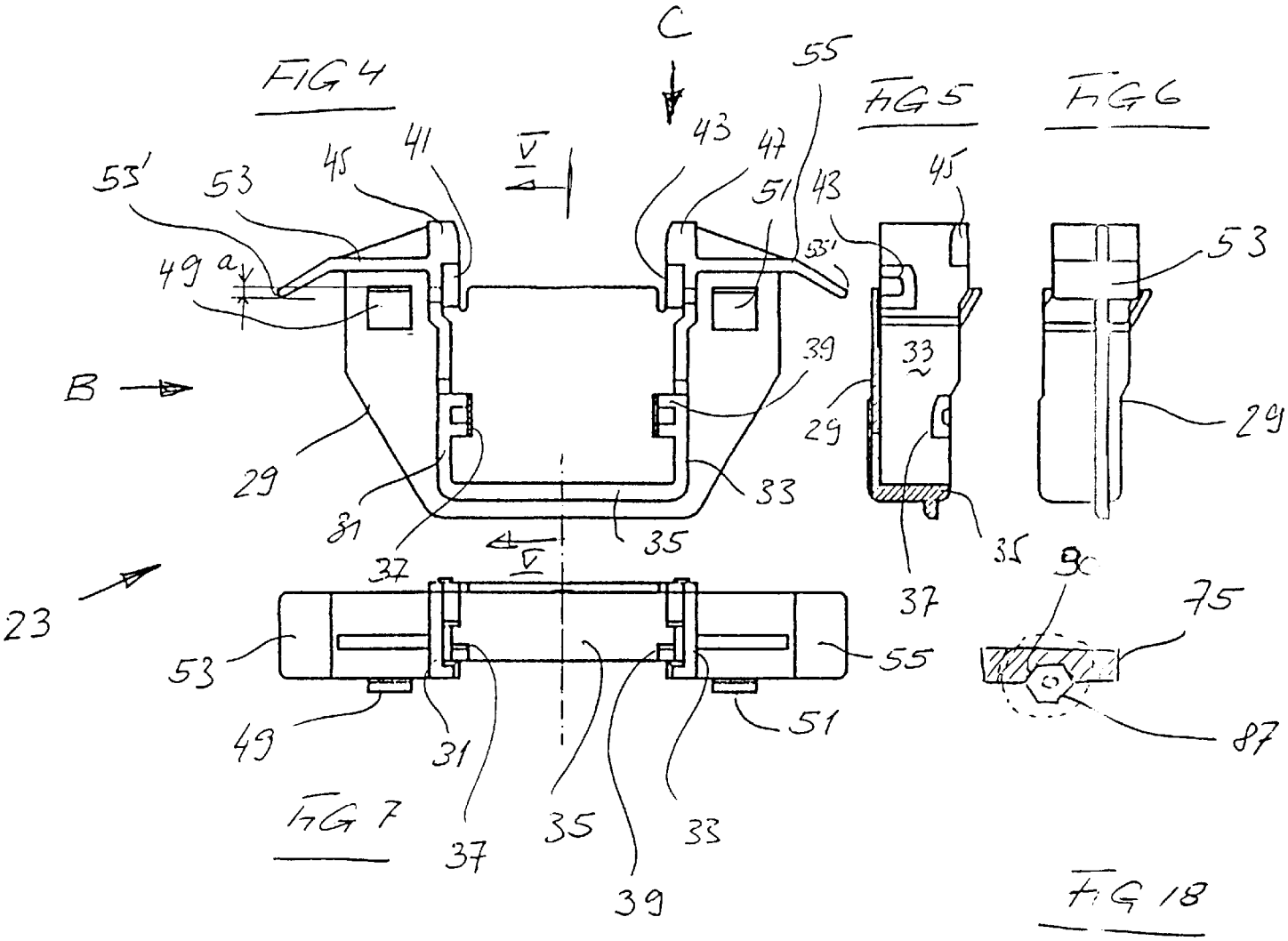
FIG. 4 is a front view of the pulley cradle receptacle.
FIG. 5 is a vertical section taken along line V—V through the receptacle in FIG. 4.
FIG. 6 is a side view from direction B of the pulley cradle receptacle in FIG. 4.
FIG. 7 is a view of the pulley cradle receptacle from direction C in FIG. 4.
FIG. 8 is a front view of the pulley cradle support.

The pulley cradle receptacle 23 has a base plate 29 to which three frame sections 31, 33, and 35 that are connected together are attached on one side. In the two vertical frame sections 31, 33 are first dogs 37 and 39 facing inward opposing one another near the bottom. At the top of the frame section 31, 33 are second dogs 41 and 43 facing inward opposing one another and that are attached offset with respect to the first dogs. Above the latter is another third pair of dogs 45, 47 attached offset with respect to them (see in particular the section according to FIG. 5).

On the surface of the base plate 29 are elastic keepers 49, 51 provided to the side of the frame sections 31, 33. Above these on both sides of the frame sections 31, 33 are wings extending outward 53, 55. The ends of the wings 53', 55' end vertically at a distance a below the upper edge of the keepers 49, 51.

Figures 8, 9, 10, 11, 12, 13, 14:
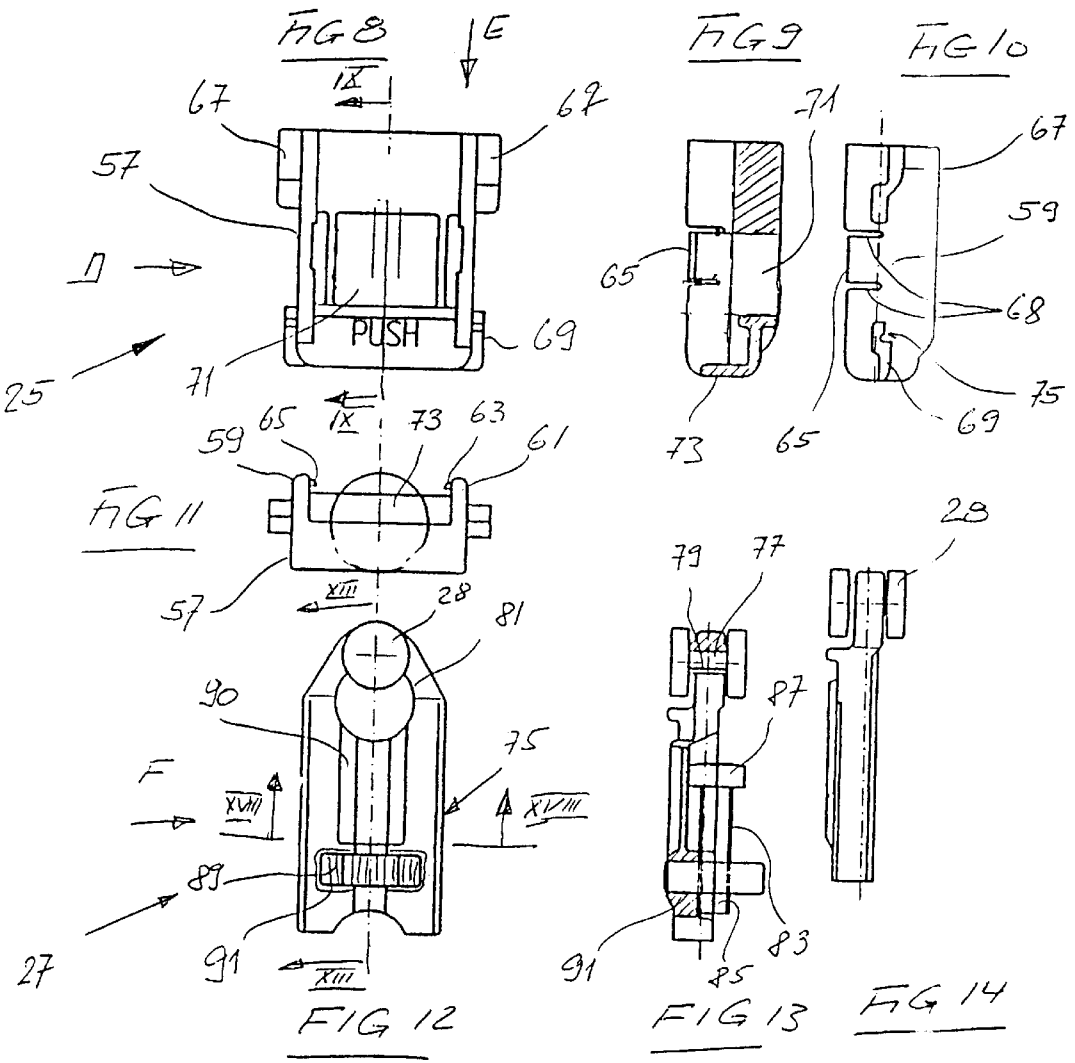
FIG. 9 is a vertical section along line IX—IX through the pulley cradle support in FIG. 8.
FIG. 10 is a side view of the pulley cradle support from direction D in FIG. 8.
FIG. 11 is a view of the pulley cradle support from direction E in FIG. 8.
FIG. 12 is a front view of the pulley cradle carrier.
FIG. 13 is a vertical section through the carrier along line XIII—XIII.
FIG. 14 is a side view from the direction of arrow F in FIG. 12.

The pulley cradle support 25, as shown in FIGS. 8 to 11, has a base member 57 with an essentially U-shaped horizontal cross section (FIG. 11). There are projections 63, 65 on both sides 59, 61 facing inward whose elasticity is affected by slits 68 made in the respective sides 59, 61. On the outsides of the two sides 59, 61 are injection molded upper guide blocks 67 and lower guide blocks 69. In addition, a notch 75 is made in block 69 that contracts the side of the upper block, resulting in the pulley cradle support 25 snapping into the pulley cradle receptacle 23. The bottom of the base member 57 is penetrated by an opening 71 that takes up essentially its entire width. The bottom edges of the two sides 59, 61 are connected together by means of a flange 73.

FIGS. 12 through 14 and 18 show the pulley cradle 27 comprised of the pulley cradle body 75 with running wheels 28 at its upper end. The running wheels 28 are connected together by means of a shaft 77. This is wedged in a slot 79 that opens up into a circular hole 81 and is a part of the pulley cradle body 75. The diameter of the circular hole 81 is larger than the diameter of the running wheels 28. The exterior contours of the pulley cradle body 75 fit between the two sides 59, 61 of the pulley cradle support 25 and the pulley cradle 27 is held in place by the projections 63, 65 that face inward when it is pushed into it. Between the pulley cradle support 25 and the pulley cradle member 75 is a screw 83 with a threaded section 85 and a hexagonal head 87 that is wedged in place when the former are put together. Three of the six surfaces of the hexagonal screw head 87 sit embedded in a trapezoidal notch 90 in the pulley cradle body 75. A knurled nut 89 is installed on the threaded section 85 of the screw 83. It protrudes through a slotted notch 91 in the pulley cradle member 75. The knurled nut 89 is held axially with a small tolerance inside of opening 91. The screw head 87 is supported at the upper edge of the opening 91 in the pulley cradle support 25 and is secured in the trapezoidal notch 90 against turning. By turning the knurled nut 89, then, the position of the shaft 77 and the rolls 28 attached to it, i.e. the position of the pulley cradle support 25, can be adjusted and shifted.

In FIGS. 15 through 17, the position of the pulley cradle arrangement 9 formed by the three parts, namely the pulley cradle receptacle 23, the pulley cradle support 25 and the pulley cradle 27, can be seen as they are assembled in the frame section 1. It can be seen in FIGS. 15 and 16 that the pulley cradle receptacle 23, i.e. its keepers 49, 51, snap into the lower edge of the folded wall sections 5' and 3', thus preventing it from coming out. The two wings 53, 55 sit on the flange 7 to the side. The wing ends 53' and 55' are bent slightly upward by the surface (in FIG. 15 not shown bent). The knurled wheel 89 is accessible through the square cutout 11.

What is claimed is:

1. A pulley cradle arrangement for a sliding door with a frame (1) made of hollow profiles, comprised of a pulley cradle receptacle (23) to be inserted into an upper frame section (1) and to connect the sliding door to the a pulley cradle (27), the pulley cradle (27) is inserted into a pulley cradle support (25) that can be pushed into the pulley cradle receptacle (23) from above and can be latched to and removed again from the pulley cradle receptacle (23) by a releasable snapping connection between the pulley cradle support and the receptacle.

2. A pulley cradle arrangement according to claim 1, wherein projections (49, 51) are formed on the pulley cradle receptacle (23) in front that snap onto the upper frame section (1), and lateral wings (53, 55) protrude over a base member (29) of the pulley cradle receptacle (23), with ends (53', 55') that sit by an amount (a) lower than the upper edges of the projections (49, 51) and that are pushed upward after pushing the pulley cradle receptacle (23) into the frame (1).

3. A pulley cradle arrangement according to claim 1, wherein the pulley cradle receptacle (23) has two vertical frame sections (31, 33), between which the pulley cradle support (25) is guided and held.

4. A pulley cradle arrangement according to claim 3, wherein at least one of first dogs (37, 39), second dogs (41, 43) and third dogs (45, 47) are built into the frame sections (31, 33) in pairs facing one another that fix the pulley cradle (27) in the pulley cradle receptacle (23).

5. A pulley cradle arrangement according to claim 4, wherein second dogs are built into the frame sections and blocks (67, 69) are formed on the pulley cradle support (25) to latch to the second dogs (41, 43) and the frame sections (31, 33).

6. A pulley cradle arrangement according to claim 4, wherein slits (75) are provided on a block (69) formed on the pulley cradle support (25) that prevent a vertical shifting of the pulley cradle support (25) within the pulley cradle receptacle (23).

7. A pulley cradle arrangement according to claim 1, wherein the pulley cradle (27) is guided in the pulley cradle support (25) and can shift vertically and has a height that can be adjusted without the use of a tool by rotating a knurled nut (89).

8. A pulley cradle arrangement according to claim 7, wherein the knurled nut (89) is engaged with a threaded section (85) of a screw (83) of the pulley cradle (27), and a head (87) of the screw (83) is held rotationally fixed, and can be longitudinally shifted along a notch (89) in the pulley cradle member (75).

9. A pulley cradle arrangement according to claim 8, wherein the knurled nut (89) penetrates on one side the pulley cradle member (75) into an opening (91) and is operated axially in the opening (91).

* * * * *